US007427960B2

(12) United States Patent
Mizutani et al.

(10) Patent No.: US 7,427,960 B2
(45) Date of Patent: Sep. 23, 2008

(54) WIRELESS TERMINAL HOLDER AND WIRELESS COMMUNICATION SYSTEM

(75) Inventors: Ryota Mizutani, Ashigarakami-gun (JP); Masao Watanabe, Ashigarakami-gun (JP); Yasuaki Konishi, Ashigarakami-gun (JP); Hiroyuki Funo, Ashigarakami-gun (JP); Kiyoshi Iida, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 11/700,119

(22) Filed: Jan. 31, 2007

(65) Prior Publication Data

US 2008/0007466 A1 Jan. 10, 2008

(30) Foreign Application Priority Data

Jul. 7, 2006 (JP) ..... 2006-188101

(51) Int. Cl.
*H01Q 1/24* (2006.01)

(52) U.S. Cl. ..... 343/702; 343/872

(58) Field of Classification Search ..... 343/702, 343/872

See application file for complete search history.

(56) References Cited

U.S. PATENT DOCUMENTS

| | | | | |
|---|---|---|---|---|
| 5,255,001 | A * | 10/1993 | Tamura et al. | 343/702 |
| 5,905,467 | A * | 5/1999 | Narayanaswamy et al. | 343/702 |
| 6,172,645 | B1 * | 1/2001 | Hollander et al. | 343/702 |
| 6,545,643 | B1 * | 4/2003 | Sward et al. | 343/702 |
| 2001/0043160 | A1 * | 11/2001 | Hirai et al. | 343/702 |

FOREIGN PATENT DOCUMENTS

| | | |
|---|---|---|
| JP | A 6-061723 | 3/1994 |
| JP | A 06-061724 | 3/1994 |
| JP | A 10-084209 | 3/1998 |
| JP | A 2002-358497 | 12/2002 |
| JP | A 2004-021484 | 1/2004 |
| JP | A 2005-130354 | 5/2005 |

* cited by examiner

*Primary Examiner*—Trinh V Dinh
(74) *Attorney, Agent, or Firm*—Oliff & Berridge, PLC

(57) ABSTRACT

A wireless terminal holder includes a body that attachably accommodates a wireless terminal that exchanges radio waves via an antenna, an antenna unit attached to the body and that is of sufficient strength to freely support the body, and that functions as the antenna for the wireless terminal when connected to an antenna terminal of the wireless terminal, and a connector attached to the body that connects the antenna unit to the antenna terminal of the wireless terminal, with the wireless terminal being accommodated in the body.

7 Claims, 3 Drawing Sheets

WIRELESS TERMINAL HOLDER AND WIRELESS COMMUNICATION SYSTEM

This application is based on and claims priority under 35 USC 119 from Japanese Patent Application No. 2006-188101 filed on Jul. 7, 2006.

BACKGROUND

1. Technical Field

The present invention relates to a wireless terminal holder and a wireless communication system.

2. Related Art

In recent years, non-contact IC tags (RFIDs), which exchange data stored in an IC chip in a non-contact manner, have been developed, and are expected to replace conventional bar-codes to become the next-generation of individual recognition technology. A non-contact IC tag includes, commonly, an IC chip for storing data and an antenna for exchanging data, and a variety of types of such tags have been developed, such as a card type, label type, and stick type. An antenna of a non-contact IC tag is commonly formed by printing a conductive coating material on an IC chip-embedded board, by depositing a wire on an IC chip-embedded board, or by etching a metal thin film formed on an IC-embedded board. Therefore, as the length of an antenna increases, the size of a board increases.

SUMMARY

To address the above problem, an aspect of the present invention provides a wireless terminal holder including a body that attachably accommodates a wireless terminal that exchanges radio waves via an antenna, an antenna unit attached to the body and that is of sufficient strength to freely support the body, and that functions as the antenna for the wireless terminal when connected to an antenna terminal of the wireless terminal, and a connector attached to the body that connects the antenna unit to the antenna terminal of the wireless terminal, with the wireless terminal being accommodated in the body.

BRIEF DESCRIPTION OF THE DRAWINGS

Embodiments of the present invention will now be described in detail with reference to the following figures, wherein.

DETAILED DESCRIPTION

An Exemplary embodiment of the present invention will now be described below with reference to the drawings.

(1) Exemplary Embodiment

Figure 1:
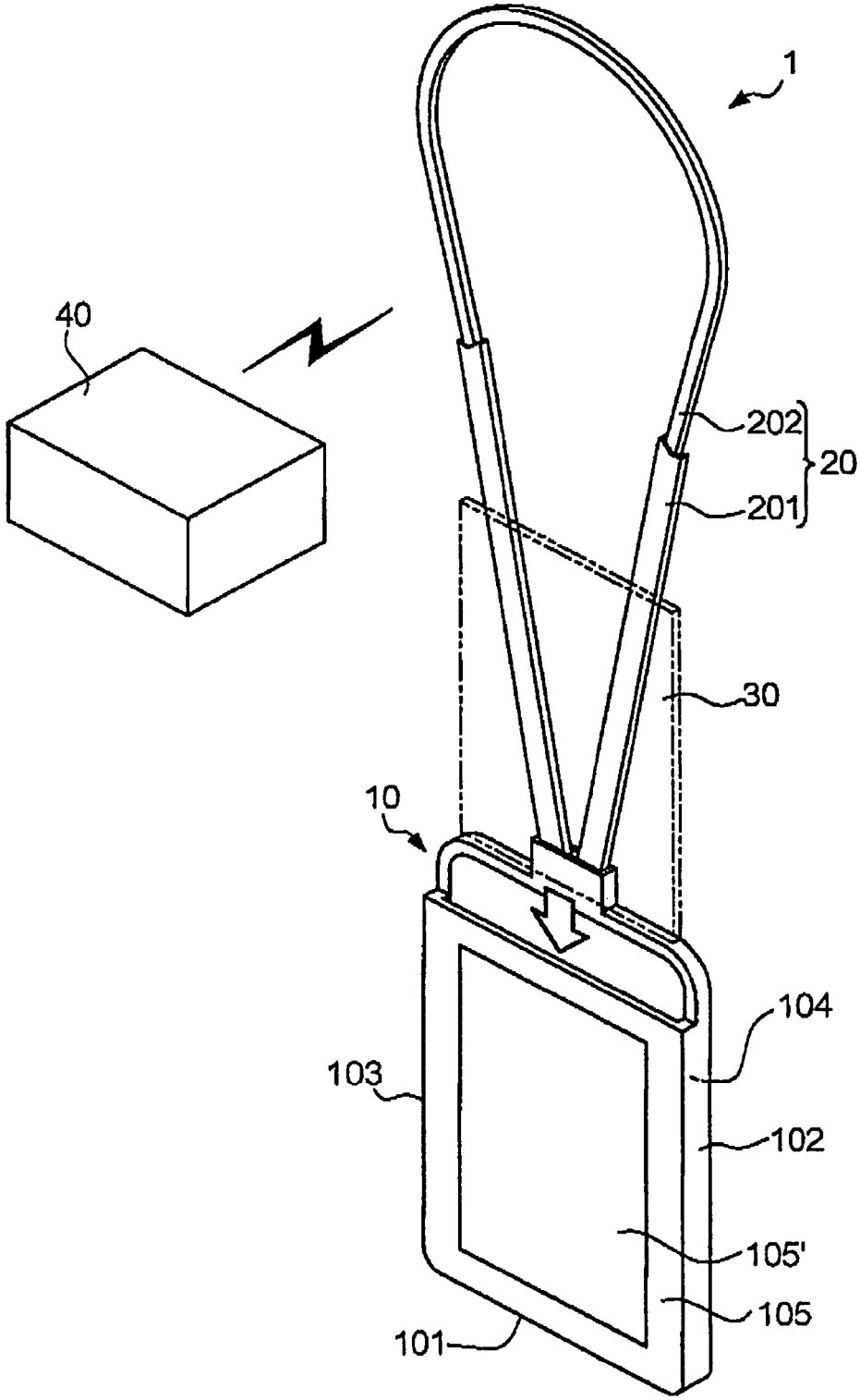
FIG. 1 is a perspective diagram illustrating wireless terminal holder is 1.

FIG. 1 is a perspective diagram illustrating wireless terminal holder 1.

As shown in the drawing, wireless holder 1 includes body 10 and antenna-containing strap 20.

Body 10 is hollow and of a rectangular parallelepiped form opening at an upper side. Body 10 includes: bottom face 101; side faces 102 and 103; rear face 104; and front face 105 in which a rectangular window 105' is provided in a central position. Body 10 is capable of accommodating card-shaped wireless terminal 30, in which case a width of body 10 is configured to be slightly longer than that of wireless terminal 30; a length of body 10 is configured to be slightly longer than that of wireless terminal 30; and the space between rear face 104 and front face 105 is spaced apart to accommodate wireless terminal 30.

Antenna-containing strap 20 includes strap 201 and antenna 202 contained in strap 201. Strap 201 can be made from chemical fiber, synthetic resin, leather, and so on. Wireless terminal holder 1 can be carried by a user by placing strap 201 around the user's neck or strap 201 can he hand held by the user. Antenna 202 contained in strap 201 is a field emission antenna such as a monopole antenna, a dipole antenna, or a loop antenna.

In a case where a monopole antenna or a dipole antenna is used as antenna 202, the length of the antenna is configured to be one fourth of the wavelength of the frequency of radio waves emitted from a reader/writer (not shown) which exchanges data with wireless terminal holder 1. Therefore, in a case where the radio wave frequency is equal to or greater than 75 MHz, the length of antenna 202 is less than or equal to 1 m. In a case where the frequency is within the UHF band (300 MHz to 3 GHz), the length of antenna 202 is from 2.5 cm to 25 cm. The distance of communication between wireless terminal holder 1 and a transmitter/receiver 40, e.g. if the communication is carried out via radio waves having faint signal strength of 300 MHz, is approximately 1 m.

In a case where a loop antenna is used as antenna 202, the length thereof is configured to be equal to one wavelength of the frequency of radio waves emitted from a transmitter/receiver 40, which exchanges data with wireless terminal holder 1. Therefore, in a case where the frequency is equal to or greater than 150 MHz, the length of antenna 202 is less than or equal to 2 m. In a case where the frequency is within the UHF band, the length of antenna 202 is from 10 cm to 1 m. If the communication is carried out via radio waves having a low signal strength of, for example, 300 MHz, a distance over which communication can be conducted between wireless terminal holder 1 and transmitter/receiver 40, is still as much as around 1 m.

To facilitate carrying of wireless terminal holder 1, the length of strap 201 is configured to make it easy for the strap to be placed around a user's neck. The length of antenna 202 is configured in accordance with a radio wave frequency used, and if the length of the antenna is longer than that of strap 201, it can be coiled so as to be accommodated within strap 201.

Figure 2:
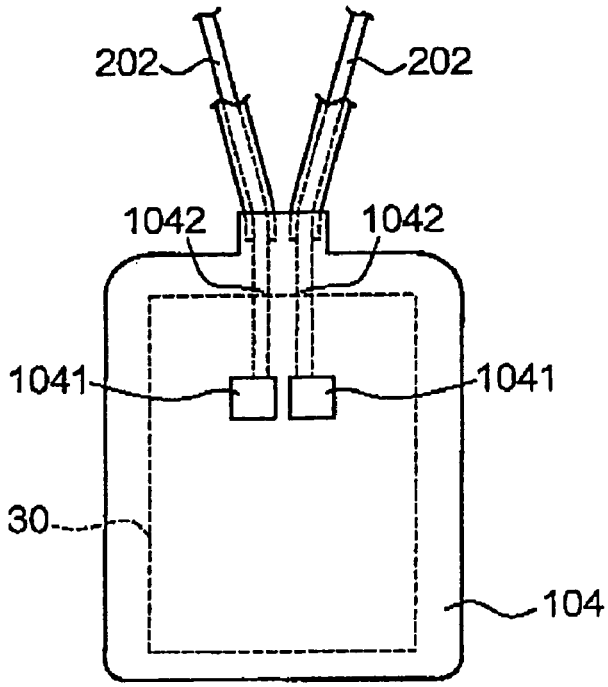
FIG. 2 is a diagram illustrating an example of an electrode pattern formed on rear face 104 of body 10 of wireless terminal holder 1.

FIG. 2 is a diagram illustrating an example of an electrode pattern formed on the inner side of rear face 104 (hereinafter, referred to simply as "rear face 104") of body 10 of wireless terminal holder 1. As shown in the drawing, rear face 104 is provided with contact terminals 1041 and connecting lines 1042 for connecting contact terminals 1041 and antenna 202.

Rear face 104 is made from an insulating material such as plastic (PET [Polyethylene Terephthalate]), vinyl chloride (polyethylene resin), polycarbonate, and polyamide; and contact terminals 1041 and connecting lines 1042 are made from a thin conductive layer such as a thin aluminum layer or a thin copper thin layer.

Contact terminals 1041 are connected to contact terminals of wireless terminal 30, to thereby enable data exchange between wireless terminal holder 1 and wireless terminal 30. Consequently, it data stored in wireless terminal 30 can be sent to a reader/writer via antenna 202 of wireless terminal holder 1. Also, data that is sent from the reader/writer via antenna 202 of wireless terminal holder 1 can be received at wireless terminal 30.

It is to be noted that the position and number of contact terminals 1041 are not restricted to the example shown in FIG. 2, but can be determined depending on a configuration of contact terminals of wireless terminal 30 attached to wireless terminal holder 1.

Figure 3:
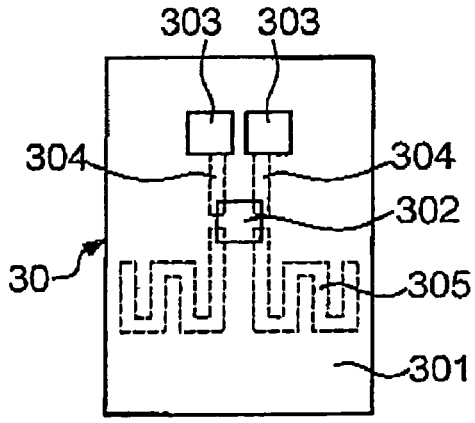
FIG. 3 is a diagram illustrating an example of a configuration of wireless terminal 30 attached to wireless terminal holder 1.

FIG. 3 is a diagram illustrating an example of a configuration of wireless terminal 30 attached to wireless terminal holder 1. As shown in the drawing, wireless terminal 30 of this example includes: base board 301; IC chip 302; contact terminals 303; connecting lines 304; and antenna element 305. The frequency band used by wireless terminal 30 is either a UHF band or microwave band.

Base board 301 of wireless terminal 30 is made from an insulating material such as plastic (PET), vinyl chloride (polyethylene resin), polycarbonate, and polyamide. Contact terminals 303, connecting lines 304, and antenna element 305 are made from a thin conductive layer such as a thin aluminum layer or a thin copper layer, and are formed by photoetching a thin conductive layer which is provided on base board 301.

IC chip 302 exchanges data with a reader/writer (not shown) via antenna element 305 through the UHF band or the microwave band.

Contact terminals 303 are connected to IC chip 302 and contact terminals 1041 of wireless terminal holder 1, to thereby enable data exchange between wireless terminal 30 and wireless terminal holder 1. Consequently, IC chip 302 of wireless terminal 30 is capable of exchanging data with a reader/writer via antenna 202 of wireless terminal holder 1.

To reiterate, by the present invention it is possible to carry out wireless communication at a frequency 300 MHz over a distance of around 1 meter, which is significantly further than a communication distance of 2 to 3 cm achievable by use of of a conventional card-type wireless terminal.

(2) Modifications

(2-1) First Modification

Figure 4:
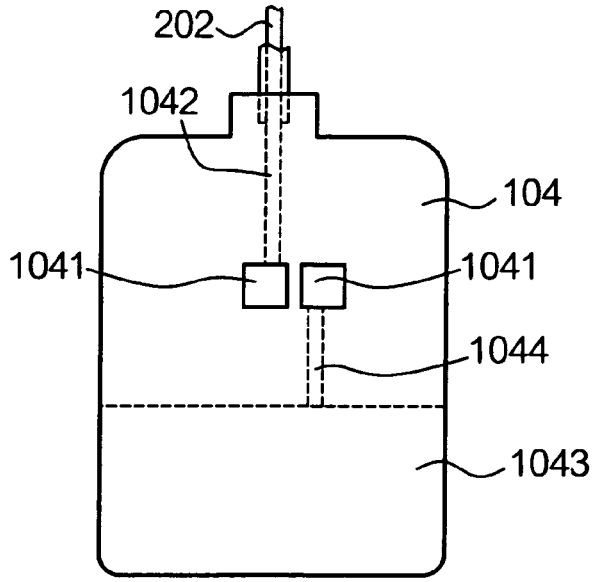
FIG. 4 is a diagram illustrating an example of an electrode pattern formed on rear face 104 of body 10 of wireless terminal holder 1.

FIG. 4 is a diagram illustrating another example of an electrode pattern formed on rear face 104 of body 10 of wireless terminal holder 1. A feeding method for antenna 202 is not restricted to a balanced feed system shown in FIG. 2, and an unbalanced feed system shown in FIG. 4 may instead be employed.

On rear face 104 shown in FIG. 4, in addition to contact terminals 1041 and connecting line 1042 for connecting contact terminals 1041 and antenna 202, ground 1043 and connecting line 1044 for connecting ground 1043 and contact terminal 1041 are formed.

It is to be noted that the position and number of contact terminals 1041 used in the present modification may be determined, as in the case shown in FIG. 2, on the basis of a configuration of contact terminals 303 of wireless terminal 30 attached to wireless terminal holder 1.

(2-2) Second Modification

Figure 5:
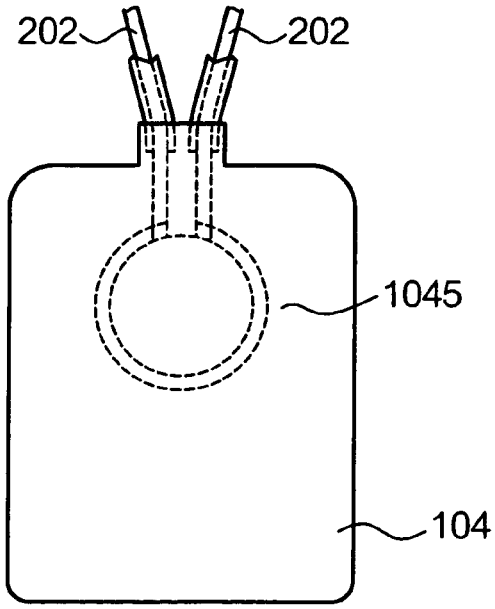
FIG. 5 is a diagram illustrating an example of an electrode pattern formed on rear face 104 of body 10 of wireless terminal holder 1.

FIG. 5 is a diagram illustrating another example of an electrode pattern formed on/inside rear face 104 of body 10 of wireless terminal holder 1. A method for connection to wireless terminal 30 is not restricted to that shown in FIG. 2, and a non-contact method shown in FIG. 5 may be employed.

On rear face 104 shown in FIG. 5, instead of contact terminals 1041 and connecting lines 1042, antenna element 1045 is formed.

Figure 6:
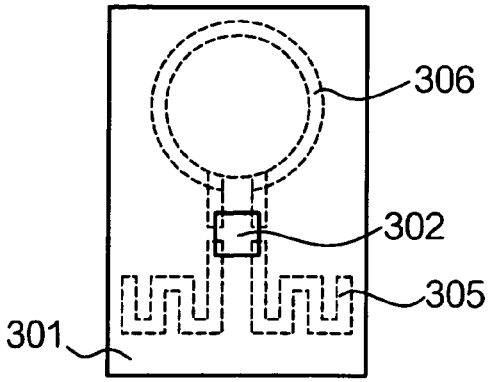
FIG. 6 is a diagram illustrating an example of a configuration of wireless terminal 30 attached to wireless terminal holder 1.

FIG. 6 is a diagram illustrating an example of a configuration of wireless terminal 30 attached to wireless terminal holder 1 having the configuration shown in FIG. 5. Wireless terminal 30 shown in the drawing includes base board 301, IC chip 302 and antenna element 305, as in the case of FIG. 3. However, the wireless terminal does not have connecting terminals 303 and connecting lines 304, and instead has antenna element 306. Antenna element 306 communicates with antenna element 1045 of wireless terminal holder 1 in a non-contact manner, and thereby enables data exchange between wireless terminal 30 and wireless terminal holder 1. Consequently, IC chip 302 of wireless terminal 30 is capable of exchanging data with a reader/writer via antenna 202 of wireless terminal holder 1. In a case where an antenna coil is formed in a wireless terminal as shown in FIG. 6, by use of only the wireless terminal, it is possible to perform short-distance wireless communication.

It is should be noted that the position of antenna element 1045 according to the present modification may be determined depending on the configuration of antenna element 306 of wireless terminal 30 attached to wireless terminal holder 1.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A wireless terminal holder comprising:

a body that attachably accommodates a removable wireless terminal that transmits and receives radio waves via an antenna;

an antenna unit attached to the body, the antenna unit supporting the body, and functioning as the antenna for the removable wireless terminal when the antenna unit is connected to an antenna terminal of the removable wireless terminal; and a connector attached to the body that connects the antenna unit to the antenna terminal of the removable wireless terminal when the removable wireless terminal is accommodated in the body.

2. The wireless terminal holder according to claim 1, wherein the antenna unit comprises:

a hollow tubular-shaped strap; and an antenna member that is conductive and contained in the strap.

3. The wireless terminal holder according to claim 1, wherein the antenna terminal and the connector each comprise a metal terminal to provide electrical connection between the antenna terminal and the body.

4. The wireless terminal holder according to claim 1, wherein the antenna terminal and the connector each have a wireless interface to enable communication to be carried out via an electromagnetic field, the connector and the antenna terminal being connectable via their respective wireless interfaces.

5. A wireless terminal holder comprising:

a removable wireless terminal that transmits and receives data at a frequency within a UHF band via an antenna;

a body that attachably accommodates the removable wireless terminal;

an antenna unit attached to the body, the antenna unit supporting the body, and functioning as the antenna for the removable wireless terminal when the antenna unit is connected to an antenna terminal of the removable wireless terminal; and a connector attached to the body that connects the antenna unit to the antenna terminal of the removable wireless terminal when the removable wireless terminal is accommodated in the body.

6. A wireless communication system comprising:

a body that attachably accommodates a removable wireless terminal that transmits and receives radio waves via an antenna;

an antenna unit attached to the body, the antenna unit supporting the body, and functioning as the antenna for the removable wireless terminal when the antenna unit is connected to an antenna terminal of the removable wireless terminal;

a connector attached to the body that connects the antenna unit to the antenna terminal of the removable wireless terminal when the removable wireless terminal is accommodated in the body;

the removable wireless terminal attachable to the wireless terminal holder; and a transmitter/receiver that communicates with the removable wireless terminal via the wireless terminal holder when the removable wireless terminal is accommodated in the body of the wireless terminal holder.

7. A wireless terminal holder comprising:

accommodating means for attachably accommodating a removable wireless terminal that transmits and receives radio waves via an antenna;

radio wave transmitting/receiving means that is attached to the accommodating means, supports the accommodating means, and functions as the antenna for the removable wireless terminal when the radio wave transmitting/receiving means is connected to an antenna terminal of he removable wireless terminal; and connecting means attached to the accommodating means for connecting the radio wave transmitting/receiving means to the antenna terminal of the removable wireless terminal when the removable wireless terminal is accommodated in the accommodating means.

* * * * *